United States Patent [19]

Lin

[11] Patent Number: 4,657,421

[45] Date of Patent: Apr. 14, 1987

[54] MECHANICAL PENCIL

[76] Inventor: Go-Sing Lin, No. 66, Min-Tzu Road, Tainan, Taiwan

[21] Appl. No.: 830,167

[22] Filed: Feb. 18, 1986

[51] Int. Cl.[4] ..... B43K 21/16

[52] U.S. Cl. ..... 401/57; 401/65; 401/85; 401/89; 401/90; 401/94

[58] Field of Search ..... 401/57, 65, 85, 94, 401/89, 90

[56] References Cited

U.S. PATENT DOCUMENTS 1,703,596 2/1929 DiRebaylio ..... 401/65

4,320,982 3/1982 Kuo ..... 401/57

*Primary Examiner*—Steven A. Bratlie

*Attorney, Agent, or Firm*—Armstrong, Nikaido, Marmelstein & Kubovcik

[57] ABSTRACT

An improvement in the mechanical pencil of the type shown in U.S. Pat. No. 4,320,982. The improved mechanical pencil has a tubular outer casing, a coil spring disposed within the outer casing and an inner tube slidably inserted through the outer casing and the coil spring, the inner tube being adapted to store therein a plurality of presharpened lead pieces and having a conical shaped head formed at its lower end, the conical head being provided with two slots to form into a pair of clamping halves for clamping and releasing the presharpened lead pieces. The coil spring, which is adapted to urge the inner tube upwards, has a lowermost coil provided with a straight tail extending from the lowermost coil inwardly and downwardly at a predetermined angle with the longitudinal center axis of the coil spring, to fit into one of the two slots of the conical shaped head of the inner tube, with the tip of the tail being arranged to abut the rear end of the lead piece clamped by the clamping halves. The outer casing has a lower end provided with a throat having a shoulder to form an annular surface for seating the lowermost coil of the coil spring in a surface-to-surface engagement, the throat also having a groove to correspond to the slot in which the tail of the coil spring fits, so as to guide the tail of the coil spring.

1 Claim, 10 Drawing Figures

MECHANICAL PENCIL

BACKGROUND OF THE INVENTION

This invention generally relates to a mechanical pencil provided with a plurality of presharpened pieces of pencil lead stored within the pencil, more particularly an improvement in the writing implement of the type shown in U.S. Pat. No. 4,320,982.

The writing implement of U.S. Pat. No. 4,320,982, as shown in FIG. 1, is composed of an outer casing 10, a coil spring 30 disposed within outer casing 10, an inner tube 20 inserted through coil spring 30, inner tube 20 having a plurality of presharpened pieces of pencil lead 50 stored therewithin and having a lower end formed into a conical head 24 which has a pair of longitudinal slots 25, 26 to form into two semi-circular lead clamps 27.

Outer casing 10 is made of a hollow tube with the two opposite ends 13, 14 being respectively tapered to form a generally conical shape; a pair of depressions 11, 11 are provided near the lower end 13 to form two inner projections in casing 10 for stopping the lower end of coil spring 30. At a suitable position of the outer mid-part of inner tube 20 there is provided a pair of first protrusions 28 for receiving the upper end of coil spring 30, and near the outer upper end of inner tube 20 there is provided a pair of second protrusions 29 for engaging with the inner side of conical shaped upper end 14 of outer casing 10. Coil spring 30 thus biases inner tube 20 upwards relative to outer casing 10, causing lead clamps 27 at the lower end 13 of inner tube 20 to squeeze into the lower end of outer casing 10 to grip lead piece 51 in lead clamps 27.

Coil spring 30 has a lower end extending inwardly downwardly in a straight line at an appropriate angle with respect to the center axis of coil spring 30, to constitute a "lead-pushing member" 33, which is aligned with and moveably fitted into slot 25, so that tip 32 of lead-pushing member 33 abuts the rear end of lead piece 51. To replace lead piece 51 with the subsequent lead piece 52, inner tube 20 is first pushed down from the top relative to outer casing 10. The downward movement of inner tube 20 causes lead clamps 27 to extend from the lower end of outer casing 10 so as to relieve the pressure clamping lead piece 51, and at the same time lead pushing member 33 is pushed by the end wall 251 of slot 25 to swing outwardly so as to clear the way for the subsequent lead piece 52 to move down with inner tube 20. By releasing the downward pressure at the upper end of inner tube 20, inner tube 20 is then allowed to move upwardly by the spring force of coil spring 30, or to return to its original position. As inner tube 20 moves upwardly, lead-pushing member 33 is allowed to spring back inwardly in such a manner that tip 32 of lead-pushing member 33 comes in abutment with the rear end of second lead piece 52. During further upward movement of inner tube 20, lead-pushing member 33 blocks the upward movement of second lead piece 52, and as a result first lead piece 51 is pushed by second lead piece to drop out of lead clamps 27 while second lead piece 52 is pushed by lead-pushing member 33 into lead clamps 27.

In the above-described writing implement, an accurate alignment of lead-pushing member 33 with slot 25 is essential for a satistactory performance. However, because the last coil 31 at the lower end of coil spring 30 is received by a pair of projections formed by two depressions 11, 11, the lower end of coil spring 30, and consequently lead-pushing member 33, tends to tilt one way or the other, causing lead-pushing member 33 to come out of slot 25, or to misalign with slot 25 as shown in FIG. 2, or causing the tip 32 of the lead pushing member 33 to shift from the channel of inner tube 20 as shown in FIG. 3, to depart from the rear end of first pencil lead 51. As a result the lead-pushing member 33 will often not perform properly.

In view of the aforesaid problem with the writing implement of U.S. Pat. No. 4,320,982, this invention offers an improvement to such a writing implement by providing an annular supporting surface on the inner side of the lower end of the outer casing for seating the lower end of the coil spring 30 so as to prevent lead-pushing member 33 from tilting, or to avoid misalignment of the lead-pushing member 33 with respect to the slot of the clamps 27. The improvement further includes a longitudinal groove formed in the inner wall of the lower end of the outer casing to correspond to the slot of the clamps 27 so as to guide lead-pushing member 33.

SUMMARY OF THE INVENTION

This invention offers an improvement to the writing implement, hereinafter as "mechanical pencil", of U.S. Pat. No. 4,320,982.

The mechanical pencil of this invention consists of an elongated, tubular shaped outer casing, a coil spring disposed within the outer casing, and an inner tube slidably inserted through the coil spring, the inner tube having a tube channel in which a plurality of pre-sharpened pieces of pencil lead are stored, and an enlarged lower end is provided with two opposite slots so as to split the lower end into two clamping halves for clamping one lead piece. The outer casing has a converging upper end formed into a conical shape, and also a conical shaped lower end with a throat and an inner shoulder forming an annular surface. The inner tube is provided with a pair of first protrusions near the outer upper end thereof and a pair of second protrusions at the outer mid-part thereof. The coil spring has an upper end retained by the second protrusions of the inner tube and a lower end having a last coil seated on the annular surface of the inner shoulder of the outer casing so as to urge the inner tube upwards with respect to the outer casing, with the first protrusions of the inner tube abuting the inner side of the converging upper end of the outer casing to stop the upward movement of the inner tube. The lower end of the coil spring has a straight tail extending from the last coil inwardly and downwardly at a suitable angle with respect to a longitudinal center axis of the coil spring to form a "lead pushing member" which is adapted to moveably fit into one of the two slots at the lower end of the inner tube. The throat in the lower end of the outer casing has an inner wall provided with a longitudinal guide groove to correspond with the aforementioned one of the two slots of the inner tube so as to guide the lead pushing member. As the lower end of the coil spring abuts the shoulder in the lower end of the outer casing in a surface-to-surface engagement, the last coil at the lower end of the coil spring will not tilt, and there is less chance for the lead pushing member to misalign with the slot of the inner tube. The guide groove further assures accurate alignment of the lead pushing member of the coil spring with the slot of the inner tube.

DETAIL DESCRIPTION OF THE INVENTION

Figure 4:
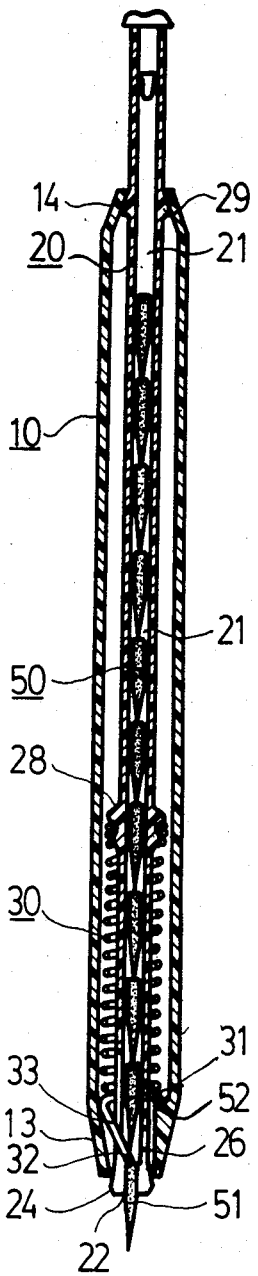
FIG. 4 is a longitudinal cross sectional view of the mechanical pencil of this invention.

As shown in FIG. 4, the mechanical pencil of this invention consists of a tubular outer casing 10 having a conical shaped, converging upper end 14 and a conical shaped lower end 13, a coil spring 30 disposed in outer casing 10, and an inner tube 20 inserted through outer casing 10 and coil spring 30, inner tube 20 having a tube channel 21 in which a plurality of presharpened pieces of pencil lead 50 are stored with their sharpened ends pointing downwards.

Figure 5:
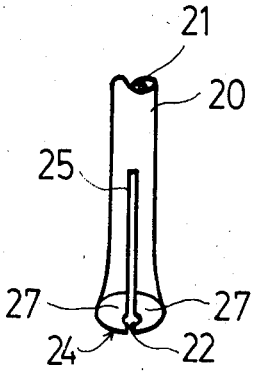
FIG. 5 is a fragmentary schematic view of the lower end of the inner tube of the mechanical pencil of FIG. 4.
Figure 6:
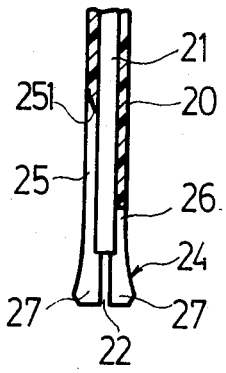
FIG. 6 is a fragmentary longitudinal cross sectional view of the lower end of the inner tube of the mechanical pencil of FIG. 4.

As shown in FIGS. 5 and 6, inner tube 20 has a lower end 24 enlarged to form a cone-like shape and provided with two opposite slots, 25, 26, one longer than the other, to split the enlarged lower end 24 into two clamping halves 27-27. Enlarged lower end 24 has a central channel 22, whose diameter is smaller than that of tube channel 21 of inner tube 20 but is approximately the same width the diameter of lead pieces 50.

Figure 8:
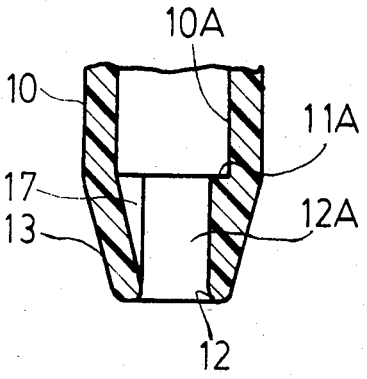
FIG. 8 is an enlarged, fragmlentary longitudinal cross sectional view of the lower end of the outer casing of the mechanical pencil of FIG. 4.
Figure 9:
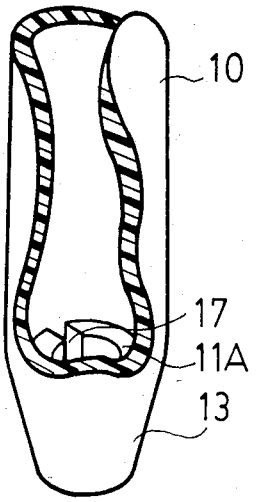
FIG. 9 is an enlarged, fragmentary, partially sectional view of the lower end of the outer casing of the mechanical pencil of FIG. 4, showing the formation of the shoulder and the guide groove.

As shown in FIG. 4, inner tube 20 is provided with a pair of first protrusions 28 at a suitable position below the outer mid-point of inner tube 20, and a pair of second protrusions 29 near the outer upper end of inner tube 20. As shown in FIGS. 8 and 9, lower end of outer casing 10 is formed with a throat 12A in which inner tube 20 is slidably inserted, throat 12A having a bell-mouth shaped lower opening 12 adapted to cooperate with the conical surface of enlarged lower end 24 of inner tube 20, and an annular shoulder llA at the upper end of throat 12A to connect with inner wall 10A of outer casing 10. Throat 12A also has an inner wall provided with a longitudinal groove 17, to be further described below.

Coil spring 30 has an upper end retained by second protrusions 28-28 and a lower end having a last coil 31 seated on annular shoulder llA in the lower end of outer casing 10, so as to urge inner tube 20 upwards with respect to outer casing 10, with second protrusions 29-29 of inner tube 20 abutting the inner side of convergent upper end 14 of outer casing 10, to stop the further upward movement of inner tube 20.

Figure 7:
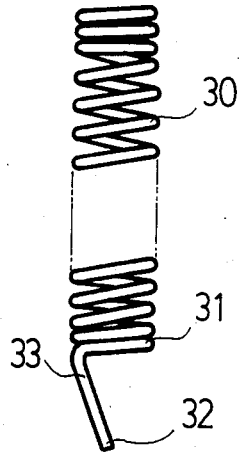
FIG. 7 is a schematic view of the coil spring employed in the mechanical pencil of FIG. 4.

As shown in FIG. 4 and FIG. 7, the last coil 31 of the lower end of coil spring 30 is provided with a straight tail extending from the last coil downwardly inwardly at a suitable angle with respect to the longitudinal center axis of coil spring 30, to form a "lead pushing member" 33, which is aligned with and moveably fit into long slot 25 formed at the lower end of inner tube 20 to allow the tip 32 of lead pushing member 33 to extend to the center of tube channel 21. Long slot 25 is so arranged to correspond with longitudinal groove 17 of throat 12 of outer casing 10 so that lead pushing member 33 is also aligned with and guided by longitudinal groove 17.

Figure 1:
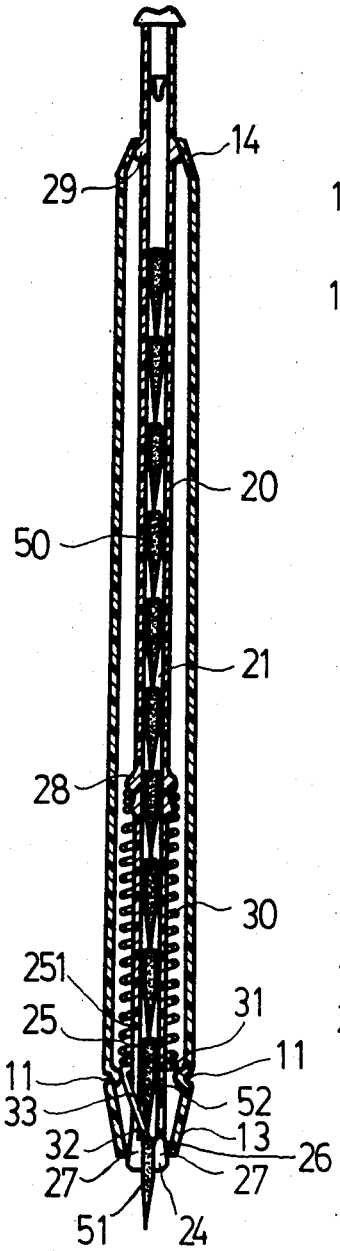
FIG. 1 PRIOR ART
FIG. 1 is a longitudinal cross sectional view of the writing implement of U.S. Pat. No. 4,320,982.
Figure 2:
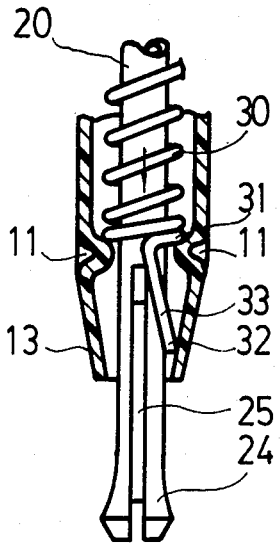
FIG. 2 PRIOR ART
FIG. 2 is a fragmentary cross sectional view of the lower end of the writing implement of FIG. 1, showing the state where the lead pushing member is misaligned with the slot of the inner tube.
Figure 3:
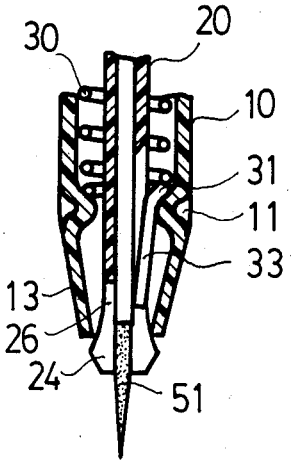
FIG. 3 PRIOR ART
FIG. 3 is a fragmentary cross sectional view of the lower end of the writing implement of FIG. 1, showing the state where the lower end of the coil spring tilts and the tip of the lead pushing member shifts from the channel of the inner tube.

Enlarged lower end 24 of inner tube is so formed that when inner tube 20, being urged by coil spring 30, is at the upper most position, clamping halves 27-27 of enlarged lower end 24 engage with and are squeezed together by bell-mouth shaped opening 12 of lower end 13 of outer casing 10, to cause clamping halves 27-27 to grip tightly first pencil lead 51. At the same time tip 32 of lead pushing member 33 is so disposed to engage with the rear end of first pencil lead 51, so shown in FIG. 1.

Figure 10:
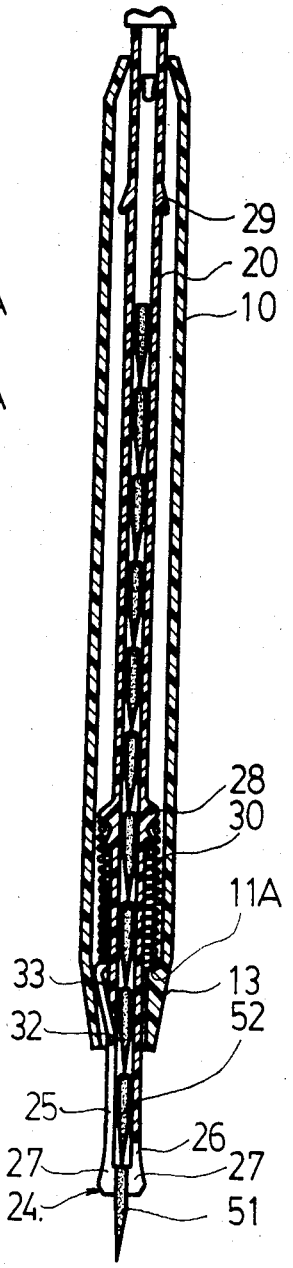
FIG. 10 is another longitudinal cross sectional view of the mechanical pencial of this invention, showing the state where the inner tube is being pushed downwardly to extend the lower end of the inner tube from the lower end of the outer casing.

To replace first pencil lead 51 when first pencil lead 51 has been used and worn, inner tube 20 is pushed down from the top as shown in FIG. 10, to cause enlarged lower end 24 of inner tube 20 to extend from bell-mouth shaped opening 12 of lower end 13 of outer casing 10, to relieve the gripping pressure on first pencil lead 51. At the same time lead pushing member 33 of coil spring 30 is pushed by upper end wall 251 (FIG. 6) of slot 25 of inner tube 20 to swing outwardly, causing tip 32 of lead pushing member 33 to move away from tube channel 21 of inner tube 20, so as to clear the way for the subsequent, second pencil lead 52 and following pencil leads to slide downwardly. The movement of lead pushing member 33 is guided by longitudinal groove 17 of outer casing 10; therefore lead pushing member 33 is always aligned with slot 25 which corresponds with longitudinal groove 17.

By releasing the downward pressure at the top of inner tube 20, inner tube 20 is allowed to move upwardly by the spring force of coil spring 30 relative to outer casing 10. As soon as inner tube 20 moves a certain distance, upper end wall 251 of long slot 25 is caused to disengage from lead pushing member 33, allowing lead pushing member 33 to spring back into slot 25, with tip 32 of lead pushing member 33 coming into engagement with the rear end of second pencil lead 52. Upon further upward movement of inner tube 20 until enlarged lower end 24 of inner tube 20 returns to engage with the bell-mouth shaped opening 12 of lower end 13 of outer casing 10, the upward movement of second pencil lead 52 is blocked by lead pushing member 33 and, as a result, first pencil lead 51 is pushed out of clamping halves 27-27 and second pencil lead 52 is inserted into channel 22 of clamping halves 27-27. Finally second pencil lead 52 is tightly clamped, with tip 32 of lead pushing member 33 abutting the rear end of second pencil lead 52 which has now replaced first pencil lead 51.

Since last coil 31 of the lower end of coil spring 30 is seated on annular shoulder llA of lower end 13 of outer casing 10 in a surface-to-surface engagement, the last coil 31, and consequently lead pushing member 33, will not tilt. Furthermore, lead pushing member 33 is always guided by longitudinal groove 17 of throat 12A, and as slot 25 of inner tube 20 corresponds with longitudinal groove 17, lead pushing member 33 will not misalign with slot 25 during the use of the mechanical pencil. The problem with conventional writing implements of the type shown in U.S. Pat. No. 4,320,982 is thus resolved.

What is claimed is:

1. A mechanical pencil, comprising:

a tubular outer casing having a cylindrical inner wall and a conical shaped lower end, said lower end having a throat provided with an upper end formed into an annular shoulder to connect with said cylindrical inner wall of outer casing, and a bell-mouth shaped lower opening, said throat also having an inner wall provided with a longitudinal groove;

a coil spring disposed within said outer casing, said coil spring having a last coil at the lower end of said coil spring and a straight tail extending from said last coil to form a lead pushing member extending downwardly and inwardly at a predetermined angle with a longitudinal center axis of said coil spring; and an inner tube inserted into said outer casing through said throat and said coil spring, said inner tube having an inside channel for storing therein a plurality of presharpened pencil leads, an enlarged lower end having a conical surface to cooperate with said bell-mouth shaped lower opening of said outer casing; said enlarged lower end having a pair of slots, one long and one short, to split said enlarged lower end into two clamping halves, said inner tube also having a first pair of protrusions formed near the upper end of said inner tube and a second pair of protrusions at a predetermined position of a mid-part of said inner tube; said long slot being disposed to correspond with said longitudinal groove of said throat of said outer casing; and said coil spring having an upper end retained by said second protrusions of said inner tube, with said last coil of said coil spring being seated on said anunular shoulder of said throat of said outer casing to urge said inner tube upward relative to said outer casing, and said lead pushing member of said coil spring being moveably fit into said long slot of said inner tube and also being guided by said longitudinal groove of said throat of said outer casing.

* * * * *